US007841219B2

(12) United States Patent
Wong et al.

(10) Patent No.: US 7,841,219 B2
(45) Date of Patent: Nov. 30, 2010

(54) FABRIC TREATING APPLIANCE UTILIZING STEAM

(75) Inventors: Nyik Siong Wong, St. Joseph, MI (US); Raveendran Vaidhyanathan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 684 days.

(21) Appl. No.: 11/464,506

(22) Filed: Aug. 15, 2006

(65) Prior Publication Data

US 2008/0041119 A1 Feb. 21, 2008

(51) Int. Cl.
*D06F 39/04* (2006.01)

(52) U.S. Cl. ..... 68/15; 68/207

(58) Field of Classification Search ..... 68/5 R, 68/5 C, 15, 23 R, 23.5, 207
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz |
| 3,234,571 | A | 2/1966 | Buss |
| 3,347,066 | A | 10/1967 | Klausner |
| 3,498,091 | A | 3/1970 | Mason |
| 3,550,170 | A | 12/1970 | Davis |
| 3,712,089 | A | 1/1973 | Toth ..... 68/210 |
| 3,801,077 | A | 4/1974 | Pearson |
| 3,830,241 | A | 8/1974 | Dye et al. |
| 3,869,815 | A | 3/1975 | Bullock |
| 3,890,987 | A | 6/1975 | Marcussen et al. |

(Continued)

FOREIGN PATENT DOCUMENTS

| | | | |
|---|---|---|---|
| CA | 1330526 | C | 7/1994 |

(Continued)

OTHER PUBLICATIONS

V-Zug Ltd Washing Machine Adora SL; User Manual; V-Zug AG, CH-6301 Zug, 2004; V-Zug Ltd Industriestrasse 66, 6301 Zug, Tel. 041 767 67 67.

*Primary Examiner*—Joseph L Perrin
(74) *Attorney, Agent, or Firm*—Clifton G. Green; McGarry Bair PC

(57) ABSTRACT

A fabric treating appliance utilizing steam for treating the fabric and having a steam generator with a conduit for directing the steam.

11 Claims, 14 Drawing Sheets

U.S. PATENT DOCUMENTS

| | | | | |
|---|---|---|---|---|
| 3,935,719 | A | 2/1976 | Henderson | |
| 4,020,396 | A | 4/1977 | Gambale et al. | |
| 4,034,583 | A | 7/1977 | Miessler | 68/16 |
| 4,045,174 | A | 8/1977 | Fuhring et al. | |
| 4,108,000 | A | 8/1978 | Norris | |
| 4,177,928 | A | 12/1979 | Bergkvist | |
| 4,207,683 | A | 6/1980 | Horton | 34/60 |
| 4,214,148 | A | 7/1980 | Fleischauer | |
| 4,263,258 | A | 4/1981 | Kalasek | |
| 4,332,047 | A | 6/1982 | Kuttelwesch | 8/158 |
| 4,373,430 | A | 2/1983 | Allen | |
| 4,386,509 | A | 6/1983 | Kuttelwesch | 68/20 |
| 4,432,111 | A | 2/1984 | Hoffmann et al. | 8/158 |
| 4,489,574 | A | 12/1984 | Spendel | |
| 4,496,473 | A | 1/1985 | Sanderson | |
| 4,527,343 | A | 7/1985 | Danneberg | |
| 4,646,630 | A | 3/1987 | McCoy et al. | |
| 4,761,305 | A * | 8/1988 | Ochiai | 427/180 |
| 4,777,682 | A | 10/1988 | Dreher et al. | 8/158 |
| 4,784,666 | A | 11/1988 | Brenner et al. | 8/137 |
| 4,809,597 | A | 3/1989 | Lin | |
| 4,879,887 | A | 11/1989 | Kagi et al. | 68/16 |
| 4,920,668 | A | 5/1990 | Henneberger et al. | |
| 4,987,627 | A | 1/1991 | Cur et al. | 8/158 |
| 4,991,545 | A | 2/1991 | Rabe et al. | |
| 5,032,186 | A | 7/1991 | Childers et al. | 134/25 |
| 5,050,259 | A | 9/1991 | Tsubaki et al. | 8/159 |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | 34/133 |
| 5,146,693 | A | 9/1992 | Dottor et al. | 34/77 |
| 5,152,252 | A | 10/1992 | Bolton et al. | |
| 5,154,197 | A | 10/1992 | Auld et al. | |
| 5,172,654 | A | 12/1992 | Christiansen | |
| 5,172,888 | A | 12/1992 | Ezekoye | |
| 5,199,455 | A | 4/1993 | Dlouhy | |
| 5,212,969 | A | 5/1993 | Tsubaki et al. | 68/19.2 |
| 5,219,370 | A | 6/1993 | Farrington et al. | |
| 5,219,371 | A | 6/1993 | Shim et al. | 8/149 |
| 5,279,676 | A | 1/1994 | Oslin et al. | |
| 5,291,758 | A | 3/1994 | Lee | 68/196 |
| 5,293,761 | A | 3/1994 | Jang | 68/15 |
| 5,315,727 | A | 5/1994 | Lee | 8/159 |
| 5,345,637 | A | 9/1994 | Pastryk et al. | 8/158 |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A | 2/2000 | Kawaguchi et al. | |
| 6,067,403 | A | 5/2000 | Morgandi | 392/401 |
| 6,094,523 | A | 7/2000 | Zelina et al. | |
| 6,122,849 | A | 9/2000 | Kida et al. | |
| 6,161,306 | A | 12/2000 | Clodic | 34/321 |
| 6,178,671 | B1 | 1/2001 | Zwanenburg et al. | |
| 6,295,691 | B1 | 10/2001 | Chen | |
| 6,327,730 | B1 | 12/2001 | Corbett | |
| 6,434,857 | B1 | 8/2002 | Anderson et al. | |
| 6,451,066 | B2 | 9/2002 | Estes et al. | |
| 6,460,381 | B1 | 10/2002 | Yoshida et al. | |
| 6,585,781 | B1 | 7/2003 | Roseen | 8/149.1 |
| 6,622,529 | B1 | 9/2003 | Crane | |
| 6,647,931 | B1 | 11/2003 | Morgandi et al. | |
| 6,691,536 | B2 * | 2/2004 | Severns et al. | 68/12.27 |
| 6,772,751 | B2 | 8/2004 | Deuringer et al. | |
| 6,789,404 | B2 | 9/2004 | Kim et al. | |
| 6,874,191 | B2 | 4/2005 | Kim et al. | |
| 6,889,399 | B2 | 5/2005 | Steiner et al. | 8/159 |
| 7,021,087 | B2 | 4/2006 | France et al. | |
| 7,096,828 | B2 | 8/2006 | Tippmann | |
| 7,290,412 | B2 | 11/2007 | Yang et al. | |
| 7,325,330 | B2 | 2/2008 | Kim et al. | |
| 7,404,304 | B2 | 7/2008 | Yang et al. | |
| 7,421,752 | B2 | 9/2008 | Donadon et al. | |
| 7,490,491 | B2 | 2/2009 | Yang et al. | |
| 7,490,493 | B2 | 2/2009 | Kim et al. | |
| 7,520,146 | B2 | 4/2009 | Kim et al. | |
| 2001/0032599 | A1 | 10/2001 | Fischer et al. | |
| 2003/0215226 | A1 | 11/2003 | Nomura et al. | |
| 2003/0226999 | A1 | 12/2003 | Hage | |
| 2004/0163184 | A1 | 8/2004 | Waldron et al. | |
| 2004/0187527 | A1 | 9/2004 | Kim et al. | 68/5 |
| 2004/0187529 | A1 | 9/2004 | Kim et al. | 68/207 |
| 2004/0200093 | A1 | 10/2004 | Wunderlin et al. | |
| 2004/0206480 | A1 | 10/2004 | Maydanik et al. | |
| 2004/0221474 | A1 | 11/2004 | Slutsky et al. | |
| 2004/0237603 | A1 | 12/2004 | Kim et al. | |
| 2004/0244432 | A1 | 12/2004 | Kim et al. | 68/5 |
| 2004/0244438 | A1 | 12/2004 | North | 68/23.2 |
| 2004/0255391 | A1 | 12/2004 | Kim et al. | 8/149 |
| 2005/0000031 | A1 | 1/2005 | Price et al. | |
| 2005/0028297 | A1 | 2/2005 | Kim et al. | |
| 2005/0034248 | A1 | 2/2005 | Oh et al. | 8/149 |
| 2005/0034249 | A1 | 2/2005 | Oh et al. | 8/159 |
| 2005/0034250 | A1 | 2/2005 | Oh et al. | 8/159 |
| 2005/0034487 | A1 | 2/2005 | Oh et al. | 68/5 |
| 2005/0034488 | A1 | 2/2005 | Oh et al. | 68/5 |
| 2005/0034489 | A1 | 2/2005 | Oh et al. | 68/5 |
| 2005/0034490 | A1 | 2/2005 | Oh et al. | 68/5 |
| 2005/0050644 | A1 | 3/2005 | Severns et al. | |
| 2005/0072382 | A1 | 4/2005 | Tippmann, Sr. | |
| 2005/0072383 | A1 | 4/2005 | Powell et al. | |
| 2005/0092035 | A1 | 5/2005 | Shin et al. | 68/275 |
| 2005/0132503 | A1 | 6/2005 | Yang et al. | 8/149 |
| 2005/0132504 | A1 | 6/2005 | Yang et al. | 8/159 |
| 2005/0132756 | A1 | 6/2005 | Yang et al. | 68/12.15 |
| 2005/0144734 | A1 | 7/2005 | Yang et al. | 8/149.3 |
| 2005/0144735 | A1 | 7/2005 | Yang et al. | 8/149.3 |
| 2005/0144737 | A1 | 7/2005 | Roepke et al. | |
| 2005/0205482 | A1 | 9/2005 | Gladney | |
| 2005/0220672 | A1 | 10/2005 | Takahashi et al. | |
| 2005/0223503 | A1 | 10/2005 | Hong et al. | 8/158 |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 | 1/2006 | Jeon et al. | |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |
| 2006/0101867 | A1 | 5/2006 | Kleker | |
| 2006/0107468 | A1 | 5/2006 | Urbanet et al. | |
| 2006/0112585 | A1 | 6/2006 | Choi et al. | |
| 2006/0117596 | A1 | 6/2006 | Kim et al. | |
| 2006/0130354 | A1 | 6/2006 | Choi et al. | |
| 2006/0137105 | A1 | 6/2006 | Hong et al. | |
| 2006/0137107 | A1 | 6/2006 | Lee et al. | |
| 2006/0150689 | A1 | 7/2006 | Kim et al. | |
| 2006/0151005 | A1 | 7/2006 | Kim et al. | |
| 2006/0151009 | A1 | 7/2006 | Kim et al. | |
| 2006/0191077 | A1 | 8/2006 | Oh et al. | |
| 2006/0191078 | A1 | 8/2006 | Kim et al. | |
| 2006/0277690 | A1 | 12/2006 | Pyo et al. | |
| 2007/0006484 | A1 | 1/2007 | Moschuetz et al. | |

| | | | |
|---|---|---|---|
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 176355 | | 10/2006 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | A2 | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 816550 | A1 * | 1/1998 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1507033 | A1 | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555339 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |

| | | | | |
|---|---|---|---|---|
| EP | 1746197 | A2 | | 1/2007 |
| EP | 1783262 | A2 | | 5/2007 |
| EP | 1813704 | A1 | | 8/2007 |
| EP | 1813709 | A2 | | 8/2007 |
| EP | 1865099 | A1 | | 12/2007 |
| EP | 1865101 | A1 | | 12/2007 |
| EP | 1889966 | A2 | | 2/2008 |
| EP | 1936023 | A1 | | 6/2008 |
| FR | 2306400 | | | 10/1976 |
| FR | 2525645 | A1 | | 10/1983 |
| FR | 2581442 | A2 | | 11/1986 |
| FR | 2688807 | A1 | | 9/1993 |
| GB | 21286 | | | 8/1898 |
| GB | 10423 | | | 11/1909 |
| GB | 21024 | | | 2/1910 |
| GB | 191010567 | A | | 4/1911 |
| GB | 191010792 | A | | 4/1911 |
| GB | 191022943 | A | | 8/1911 |
| GB | 191024005 | A | | 10/1911 |
| GB | 191103554 | A | | 12/1911 |
| GB | 102466 | A | | 12/1916 |
| GB | 285384 | A | | 11/1928 |
| GB | 397236 | | | 8/1933 |
| GB | 514440 | A | | 11/1939 |
| GB | 685813 | | | 1/1953 |
| GB | 799788 | | | 8/1958 |
| GB | 835250 | | | 5/1960 |
| GB | 881083 | | | 11/1961 |
| GB | 889500 | A | | 2/1962 |
| GB | 1155268 | A | | 6/1969 |
| GB | 1331623 | | | 9/1973 |
| GB | 1352955 | | | 5/1974 |
| GB | 1366852 | A | | 9/1974 |
| GB | 2219603 | A | | 12/1989 |
| GB | 2309071 | A | | 7/1997 |
| GB | 2348213 | | | 9/2000 |
| JP | 35021275 | | | 8/1950 |
| JP | 36023044 | | | 9/1960 |
| JP | 36000067 | | | 7/1961 |
| JP | 52146973 | | | 12/1977 |
| JP | 54068072 | A | | 5/1979 |
| JP | 57094480 | | | 6/1982 |
| JP | 57032858 | | | 7/1982 |
| JP | 60138399 | A | | 7/1985 |
| JP | 61128995 | | | 6/1986 |
| JP | 61128995 | A | * | 6/1986 |
| JP | 62066891 | | | 3/1987 |
| JP | 2049700 | A | | 2/1990 |
| JP | 02161997 | | | 6/1990 |
| JP | 02026465 | | | 7/1990 |
| JP | 02198595 | | | 8/1990 |
| JP | 2239894 | | | 9/1990 |
| JP | 2242088 | A | | 9/1990 |
| JP | 02267402 | | | 11/1990 |
| JP | 03025748 | | | 6/1991 |
| JP | 3137401 | A | | 6/1991 |
| JP | 04158896 | | | 6/1992 |
| JP | 4158896 | A | | 6/1992 |
| JP | 05023493 | | | 2/1993 |
| JP | 05115672 | A | | 5/1993 |
| JP | 05146583 | | | 6/1993 |
| JP | 05269294 | | | 10/1993 |
| JP | 5346485 | A | | 12/1993 |
| JP | 06123360 | | | 5/1994 |
| JP | 08261689 | | | 10/1996 |
| JP | 9133305 | A | | 5/1997 |
| JP | 10235088 | A | | 9/1998 |
| JP | 11047488 | A | | 2/1999 |
| JP | 11164979 | | | 6/1999 |
| JP | 11164980 | | | 6/1999 |
| JP | 11226290 | | | 8/1999 |
| JP | 2000176192 | | | 6/2000 |
| JP | 2003019382 | | | 1/2003 |
| JP | 2003093775 | | | 4/2003 |
| JP | 2003311068 | | | 11/2003 |
| JP | 2003311084 | | | 11/2003 |
| JP | 2003320324 | | | 11/2003 |
| JP | 2003326077 | | | 11/2003 |
| JP | 2004061011 | | | 2/2004 |
| JP | 2004121666 | | | 4/2004 |
| JP | 2004167131 | | | 6/2004 |
| JP | 2004298614 | | | 10/2004 |
| JP | 2004298616 | | | 10/2004 |
| JP | 2004313793 | | | 11/2004 |
| JP | 2005058740 | | | 3/2005 |
| JP | 2005058741 | | | 3/2005 |
| JP | 2005177440 | | | 7/2005 |
| JP | 2005177445 | | | 7/2005 |
| JP | 2005177450 | | | 7/2005 |
| JP | 2005192997 | | | 7/2005 |
| JP | 2005193003 | | | 7/2005 |
| JP | 2006109886 | | | 4/2006 |
| JP | 2006130295 | A | | 5/2006 |
| JP | 2004167131 | | | 9/2007 |
| KR | 20-1993-19820 | | * | 9/1993 |
| KR | 9319820 | | | 9/1993 |
| KR | 1019950018856 | | | 7/1995 |
| KR | 1019970011098 | | | 3/1997 |
| KR | 1019970070295 | | | 11/1997 |
| KR | 2019970039170 | | | 7/1998 |
| KR | 200128631 | | | 8/1998 |
| KR | 100146947 | | | 10/1998 |
| KR | 20010015043 | | | 2/2001 |
| KR | 10220010010111 | | | 2/2001 |
| KR | 20040085509 | A | | 10/2004 |
| KR | 20050017481 | A | | 2/2005 |
| KR | 20060031165 | A | | 4/2006 |
| WO | 9214954 | | | 9/1992 |
| WO | 9307798 | A1 | | 4/1993 |
| WO | 9319237 | A1 | | 9/1993 |
| WO | 97/15709 | | | 5/1997 |
| WO | 98/03175 | | | 1/1998 |
| WO | 01/11134 | | | 2/2001 |
| WO | 0174129 | A2 | | 10/2001 |
| WO | 03/012185 | | | 2/2003 |
| WO | 03012185 | A2 | | 2/2003 |
| WO | 03057966 | | | 7/2003 |
| WO | 2004/059070 | | | 7/2004 |
| WO | 2004091359 | A2 | | 10/2004 |
| WO | 2005001189 | A1 | | 1/2005 |
| WO | 2005018837 | A1 | | 3/2005 |
| WO | 2005115095 | | | 12/2005 |
| WO | 2006001612 | | | 1/2006 |
| WO | 2006009364 | A1 | | 1/2006 |
| WO | 2006070317 | A1 | | 7/2006 |
| WO | 2006090973 | | | 8/2006 |
| WO | 2006091054 | | | 8/2006 |
| WO | 2006091057 | A1 | | 8/2006 |
| WO | 2006098571 | | | 9/2006 |
| WO | 2006098572 | | | 9/2006 |
| WO | 2006098573 | | | 9/2006 |
| WO | 2006101304 | | | 9/2006 |
| WO | 2006101312 | | | 9/2006 |
| WO | 2006101336 | | | 9/2006 |
| WO | 2006101336 | A1 | | 9/2006 |
| WO | 2006101345 | | | 9/2006 |
| WO | 2006101358 | | | 9/2006 |
| WO | 2006101360 | | | 9/2006 |
| WO | 2006101361 | | | 9/2006 |
| WO | 2006101362 | | | 9/2006 |
| WO | 2006101363 | | | 9/2006 |
| WO | 2006101365 | | | 9/2006 |
| WO | 2006101372 | | | 9/2006 |
| WO | 2006101376 | | | 9/2006 |
| WO | 2006101377 | | | 9/2006 |
| WO | 2006101377 | A1 | | 9/2006 |

| | | | |
|---|---|---|---|
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

FABRIC TREATING APPLIANCE UTILIZING STEAM

BACKGROUND OF THE INVENTION

1. Field of the Invention

The invention relates to a fabric treatment appliance with a steam generator.

2. Description of the Related Art

Some fabric treatment appliances, such as a washing machine, a clothes dryer, and a fabric refreshing or revitalizing machine, utilize steam generators for various reasons. The steam from the steam generator can be used to, for example, heat water, heat a load of fabric items and any water absorbed by the fabric items, dewrinkle fabric items, remove odors from fabric items, etc.

In some fabric treatment appliances, the steam generator, positioned externally of a fabric treatment chamber and fluidly coupled to the fabric treatment chamber, such as by a conduit, delivers steam to the fabric treatment chamber. The steam generator can provide pressurized or non-pressurized steam. When the steam generator provides pressurized steam, the pressure of the steam facilitates transporting the steam from the steam generator to the fabric treatment chamber. When the steam is non-pressurized, a fan or blower located in the conduit can facilitate transporting the steam to the fabric treatment chamber. Incorporating a fan or blower, however, adds cost and complexity to the fabric treatment appliance.

SUMMARY OF THE INVENTION

The invention relates to a fabric treatment appliance comprising at least one of a tub and drum defining a fabric treatment chamber; a steam generator; and a steam conduit fluidly coupling the steam generator to the at least one of the tub and drum to supply steam to the fabric treatment chamber, the steam conduit having an inlet fluidly coupled to the steam generator and an outlet fluidly coupled to the at least one of the tub and drum and defining a high point of the steam conduit.

DESCRIPTION OF EMBODIMENTS OF THE INVENTION

Figure 1:
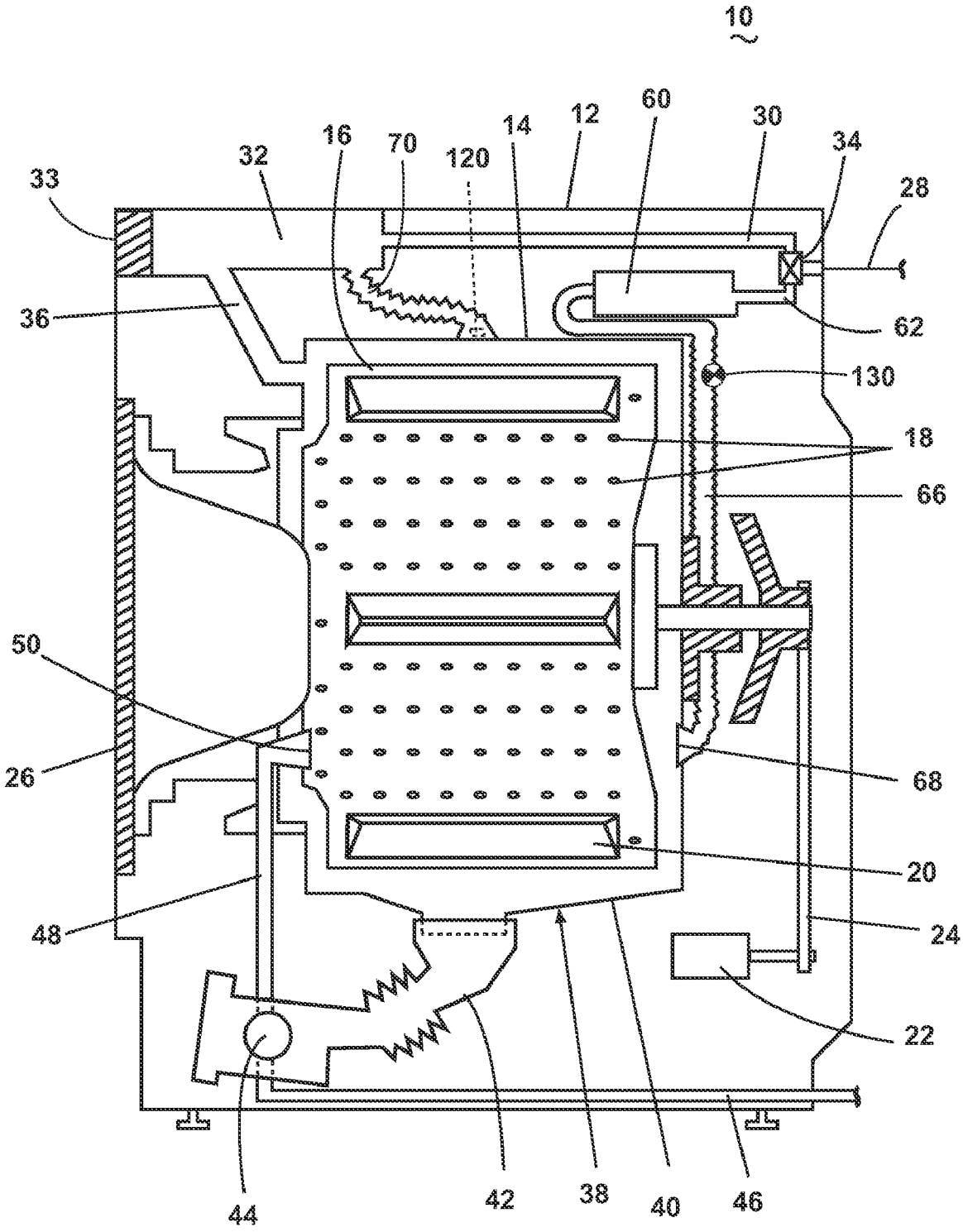
FIG. 1 is a schematic view of a fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance can be any machine that treats fabrics, and examples of the fabric treatment appliance include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing machine; an extractor; a non-aqueous washing apparatus; and a revitalizing machine. For illustrative purposes, the invention will be described with respect to a washing machine, with it being understood that the invention can be adapted for use with any type of fabric treatment appliance having a steam generator.

The washing machine 10 of the illustrated embodiment comprises a cabinet 12 that houses a stationary tub 14. A rotatable drum 16 mounted within the tub 14 defines a fabric treatment chamber and includes a plurality of perforations 18, and liquid can flow between the tub 14 and the drum 16 through the perforations 18. The drum 16 further comprises a plurality of baffles 20 disposed on an inner surface of the drum 16 to lift fabric items contained in the drum 16 while the drum 16 rotates, as is well known in the washing machine art. A motor 22 coupled to the drum 16 through a belt 24 rotates the drum 16. Both the tub 14 and the drum 16 can be selectively closed by a door 26.

Washing machines are typically categorized as either a vertical axis washing machine or a horizontal axis washing machine. As used herein, the "vertical axis" washing machine refers to a washing machine comprising a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. In vertical axis machines a clothes mover, such as an agitator, auger, impeller, to name a few, moves within a wash basket to impart mechanical energy directly to the clothes or indirectly through wash liquid in the wash basket. The clothes mover is typically moved in a reciprocating rotational movement. The illustrated exemplary washing machine of FIG. 1 is a horizontal axis washing machine.

The motor 22 can rotate the drum 16 at various speeds in opposite rotational directions. In particular, the motor 22 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the baffles 20. Alternatively, the motor 22 can rotate the drum 16 at spin speeds wherein the fabric items rotate with the drum 16 without falling.

The washing machine 10 of FIG. 1 further comprises a liquid supply and recirculation system. Liquid, such as water, can be supplied to the washing machine 10 from a household water supply 28. A first supply conduit 30 fluidly couples the water supply 28 to a detergent dispenser 32. The detergent dispenser 32 can be accessed by a user through an access opening 33 in the cabinet 12, such as for providing a wash aid to the detergent dispenser 32. An inlet valve 34 controls flow of the liquid from the water supply 28 and through the first supply conduit 30 to the detergent dispenser 32. The inlet valve 34 can be positioned in any suitable location between the water supply 28 and the detergent dispenser 32. A liquid conduit 36 fluidly couples the detergent dispenser 32 with the tub 14. The liquid conduit 36 can couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and flows by gravity to a sump 38 formed in part by a lower portion 40 of the tub 14. The sump 38 is also formed by a sump conduit 42 that fluidly couples the lower portion 40 of the tub 14 to a pump 44. The pump 44 can direct fluid to a drain conduit 46, which drains the liquid from the washing machine 10, or to a recirculation conduit 48, which terminates at a recirculation inlet 50. The recirculation inlet 50 directs the liquid from the recirculation conduit 48 into the drum 16. The recirculation inlet 50 can introduce the liquid into the drum 16 in any suitable manner, such as by spraying, dripping, or providing a steady flow of the liquid.

The exemplary washing machine 10 further includes a steam generation system. The steam generation system comprises a steam generator 60 that receives liquid from the water supply 28 through a second supply conduit 62. The inlet valve 34 controls flow of the liquid from the water supply 28 and through the second supply conduit 62 to the steam generator 60. The inlet valve 34 can be positioned in any suitable location between the water supply 28 and the steam generator 60. A steam conduit 66 fluidly couples the steam generator 60 to a steam inlet 68, which introduces steam into the tub 14. The steam inlet 68 can couple with the tub 14 at any suitable location on the tub 14 and is shown as being coupled to a rear wall of the tub 14 in FIG. 1 for exemplary purposes. The steam that enters the tub 14 through the steam inlet 68 subsequently enters the drum 16 through the perforations 18. Alternatively, the steam inlet 68 can be configured to introduce the steam directly into the drum 16. The steam inlet 68 can introduce the steam into the tub 14 in any suitable manner.

The steam generator 60 can be any type of device that converts the liquid to steam. For example, the steam generator 60 can be a tank-type steam generator that stores a volume of liquid and heats the volume of liquid to convert the liquid to steam. Alternatively, the steam generator 60 can be an in-line steam generator that converts the liquid to steam as the liquid flows through the steam generator 60. The steam generator 60 can produce pressurized or non-pressurized steam.

Exemplary steam generators are disclosed in our Ser. No. 11/450,528, titled "Removal of Scale and Sludge in a Steam Generator of a Fabric Treatment Appliance," our Ser. No. 11/450,836, titled "Prevention of Scale and Sludge in a Steam Generator of a Fabric Treatment Appliance," and our Ser. No. 11/450,714, titled "Draining Liquid From a Steam Generator of a Fabric Treatment Appliance, all filed Jun. 9, 2006, in addition to our Ser. No. 11/464,509, titled "Water Supply Control for a Steam Generator of a Fabric Treatment Appliance," our Ser. No. 11/464,514, titled "Water Supply Control for a Steam Generator of a Fabric Treatment Appliance Using a Weight Sensor," and our Ser. No. 11/464,513, titled "Water Supply Control for a Steam Generator of a Fabric Treatment Appliance Using a Temperature Sensor," all filed concurrently herewith, which are incorporated herein by reference in their entirety.

In addition to producing steam, the steam generator 60, whether an in-line steam generator, a tank-type steam generator, or any other type of steam generator, can heat water to a temperature below a steam transformation temperature, whereby the steam generator 60 produces hot water. The hot water can be delivered to the tub 14 and/or drum 16 from the steam generator 60. The hot water can be used alone or can optionally mix with cold water in the tub 14 and/or drum 16. Using the steam generator to produce hot water can be useful when the steam generator 60 couples only with a cold water source of the water supply 28.

The liquid supply and recirculation system and the steam generator system can differ from the configuration shown in FIG. 1, such as by inclusion of other valves, conduits, wash aid dispensers, and the like, to control the flow of liquid and steam through the washing machine 10 and for the introduction of more than one type of detergent/wash aid. For example, a valve can be located in the liquid conduit 36, in the recirculation conduit 48, and in the steam conduit 66. Furthermore, an additional conduit can be included to couple the water supply 28 directly to the tub 14 or the drum 16 so that the liquid provided to the tub 14 or the drum 16 does not have to pass through the detergent dispenser 32. Alternatively, the liquid can be provided to the tub 14 or the drum 16 through the steam generator 60 rather than through the detergent dispenser 32 or the additional conduit. As another example, the liquid conduit 36 can be configured to supply liquid directly into the drum 16, and the recirculation conduit 48 can be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in our Ser. No. 11/450,636, titled "Method of Operating a Washing Machine Using Steam;" our Ser. No. 11/450,529, titled "Steam Washing Machine Operation Method Having Dual Speed Spin Pre-Wash;" and our Ser. No. 11/450,629, titled "Steam Washing Machine Operation Method Having Dry Spin Pre-Wash," all filed Jun. 9, 2006, which are incorporated herein by reference in their entirety.

The washing machine 10 can further comprise a controller coupled to various working components of the washing machine 10, such as the pump 44, the motor 22, the inlet valve 34, the flow controller 64, the detergent dispenser 32, and the steam generator 60, to control the operation of the washing machine 10. The controller can receive data from the working components and can provide commands, which can be based on the received data, to the working components to execute a desired operation of the washing machine 10.

Figure 2:
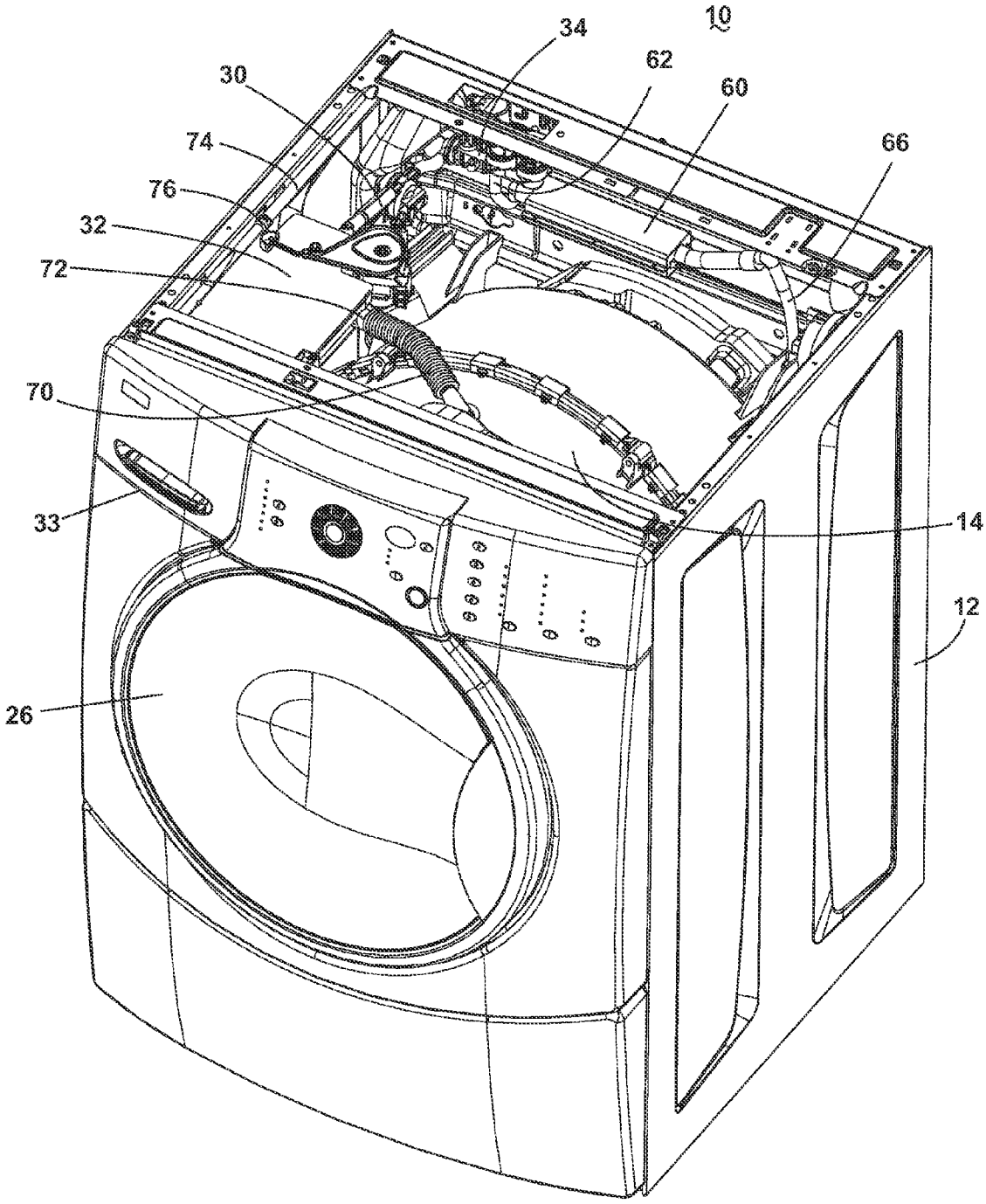
FIG. 2 is a perspective view of the washing machine of FIG. 1 with a top panel of a cabinet removed.

The washing machine 10 can further include an exhaust system for managing steam exhaust from the tub 14. During operation of the washing machine 10, fabric items in the drum 16, liquid absorbed by the fabric items, and free liquid in the washing machine 10 absorb a portion of the steam, while a portion of the steam remains unabsorbed. Rotation of the drum 16 helps to retain the unabsorbed steam within the fabric treatment chamber, but at least some of the unabsorbed steam leaves the drum 16 and the tub 14 through an exhaust conduit 70. In the exhaust system of FIG. 1, the exhaust conduit 70 fluidly couples the tub 14 to the detergent dispenser 32. The exhaust conduit 70 and the detergent dispenser 32 are shown more clearly in FIG. 2, which is a perspective view of the washing machine 10 with a top panel of the cabinet 12 removed. The exhaust conduit 70 can be coupled to a top portion of the tub 14, as shown in FIG. 2, or any other suitable portion of the tub 14. Because steam naturally rises, locating the exhaust conduit 70 at the top of the tub 14 takes advantage of the inherent flow behavior of the steam.

Figure 3:
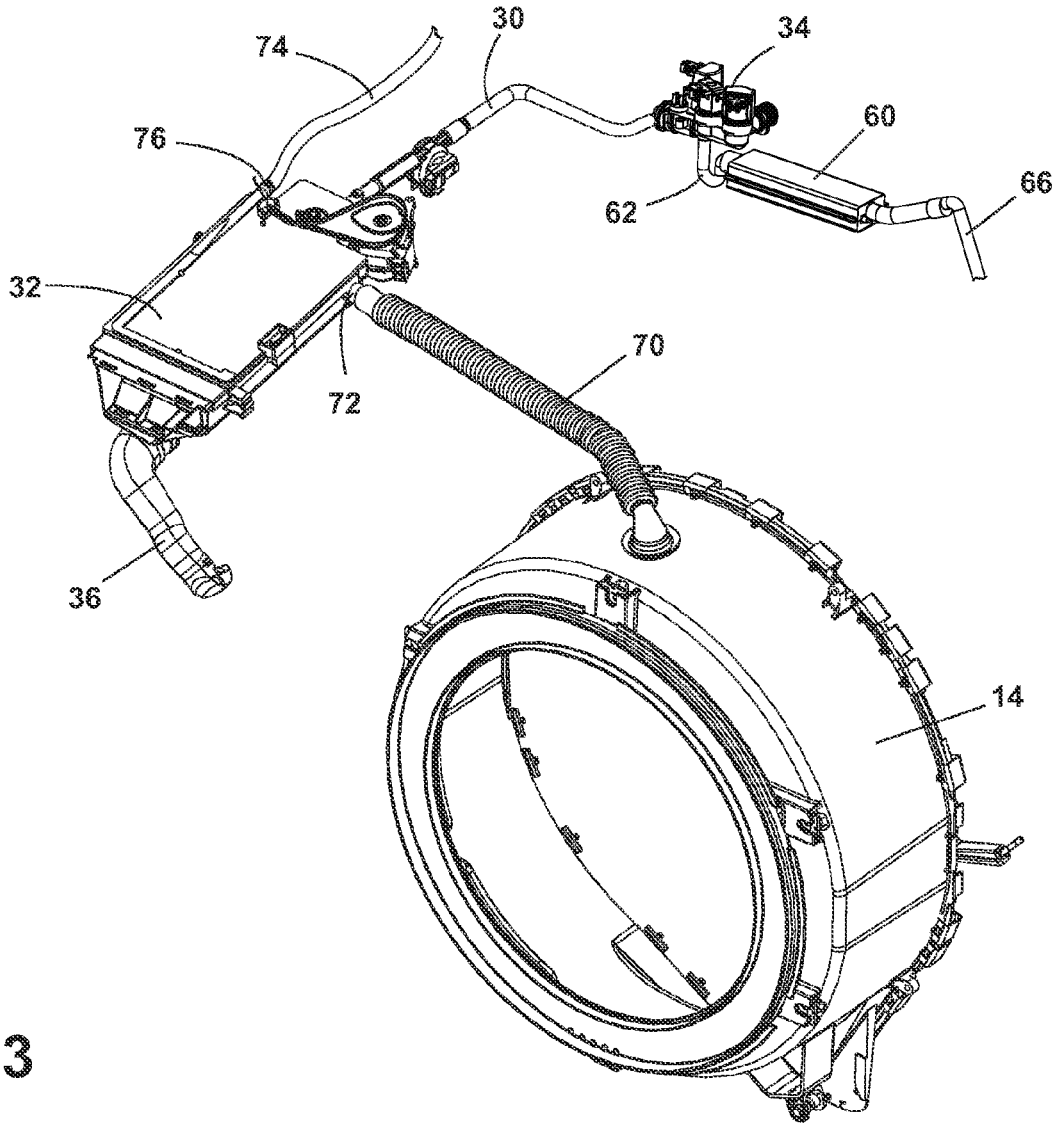
FIG. 3 is a perspective view of select components of an exhaust system, a steam generator system, and a liquid supply and recirculation system of the washing machine of FIGS. 1 and 2.

Referring now to FIG. 3, which is a perspective view of certain components of the exhaust system, the steam generator system, and the liquid supply and recirculation system, the exhaust conduit 70 directs the steam to the detergent dispenser 32, and the steam enters the detergent dispenser 32 at a detergent dispenser steam inlet 72. The detergent dispenser 32 can function as a condenser whereby the steam converts from a vapor to water in the detergent dispenser. Using the detergent dispenser as a condenser of the exhaust system employs an existing component of the washing machine 10 and thereby reduces cost of the exhaust system. The detergent dispenser 32 has a temperature less than that of the steam and can contain liquid also having a lower temperature than that of the steam. Consequently, when the steam contacts the detergent dispenser 32 and any liquid contained in the detergent dispenser 32, heat transfers from the steam to the detergent dispenser 32 and the liquid. As the steam loses heat, the temperature of the steam lowers to below a steam transformation temperature, and the steam converts to water. The water resulting from the condensation of the steam can remain in the detergent dispenser 32 for future use. Optionally, the water in the detergent dispenser 32 can be drained, such as through the liquid conduit 36, the tub 14, the sump 38, and the pump 44 to the drain conduit 46.

If the detergent dispenser 32 does not condense all of the steam provided through the detergent dispenser steam inlet 72, then the excess steam can leave the detergent dispenser 32 and flow to the atmosphere external to the washing machine 10. For example, the steam can flow through the access opening 33 (FIGS. 1 and 2), whereby the access opening 33 forms a detergent dispenser steam outlet, or through a second exhaust conduit 74 coupling a detergent dispenser steam outlet 76 to the atmosphere external to the washing machine 10. Thus, in the exemplary exhaust system just described, the steam from the fabric treatment chamber can flow through a steam exhaust passage formed by the exhaust conduit 70 to the detergent dispenser 32, and the steam exhaust passage continues through either the access opening 33 or the second exhaust conduit 74 to the atmosphere.

Optionally, the second exhaust conduit 74 can ascend from the detergent dispenser steam outlet 76 to the atmosphere to take advantage of the natural upward flow behavior of steam. In such a configuration, the second exhaust conduit 74 need not ascend at all locations between the detergent dispenser steam outlet 76 and the atmosphere. To exploit the natural upward flow of the steam, the connection between the second exhaust conduit 74 and the detergent dispenser steam outlet 76 should be positioned below the connection between the second exhaust conduit 94 and the atmosphere.

Figure 4:
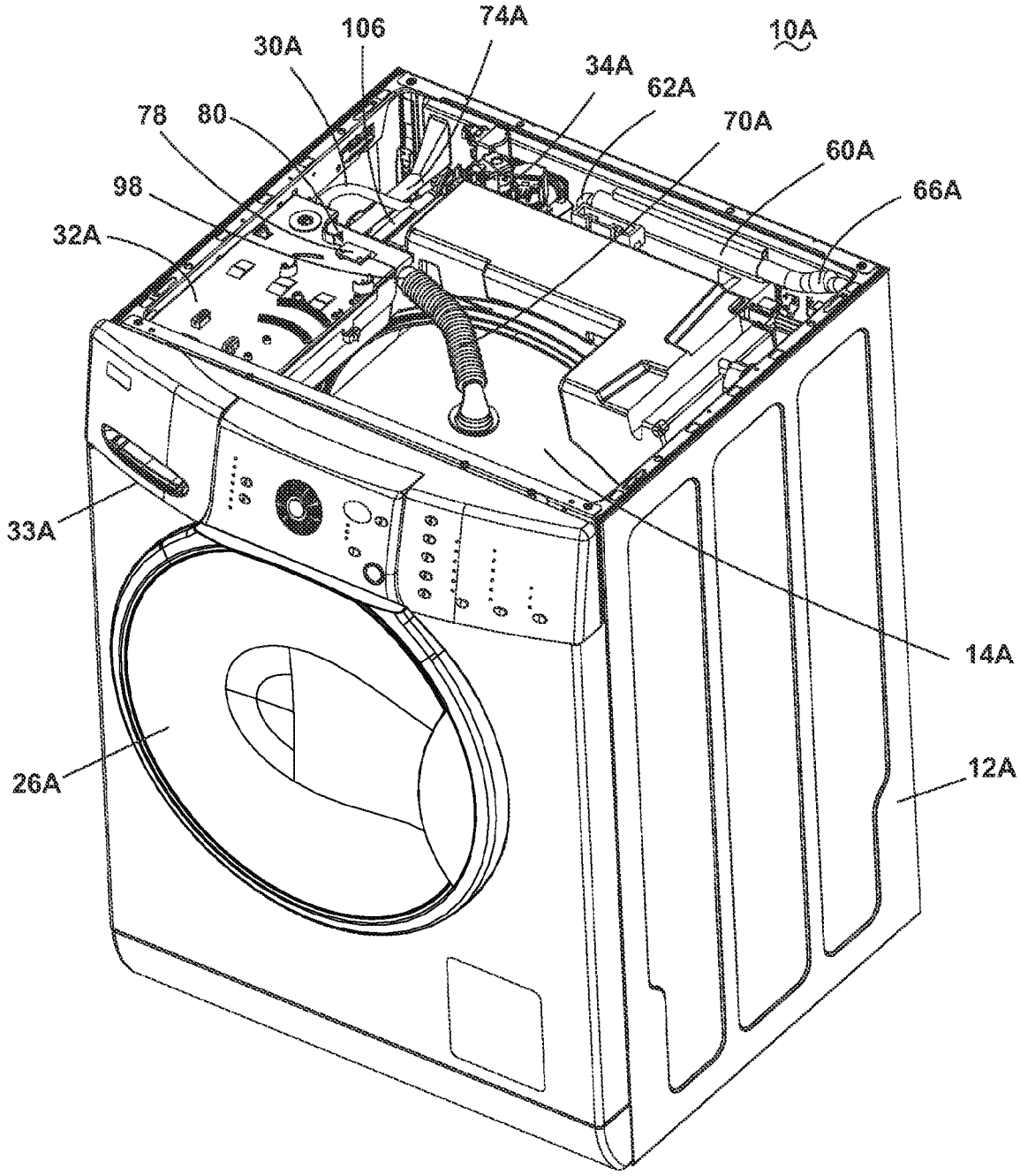
FIG. 4 is a perspective view of an alternative washing machine according to another embodiment of the invention with a top panel of a cabinet removed.
Figure 5:
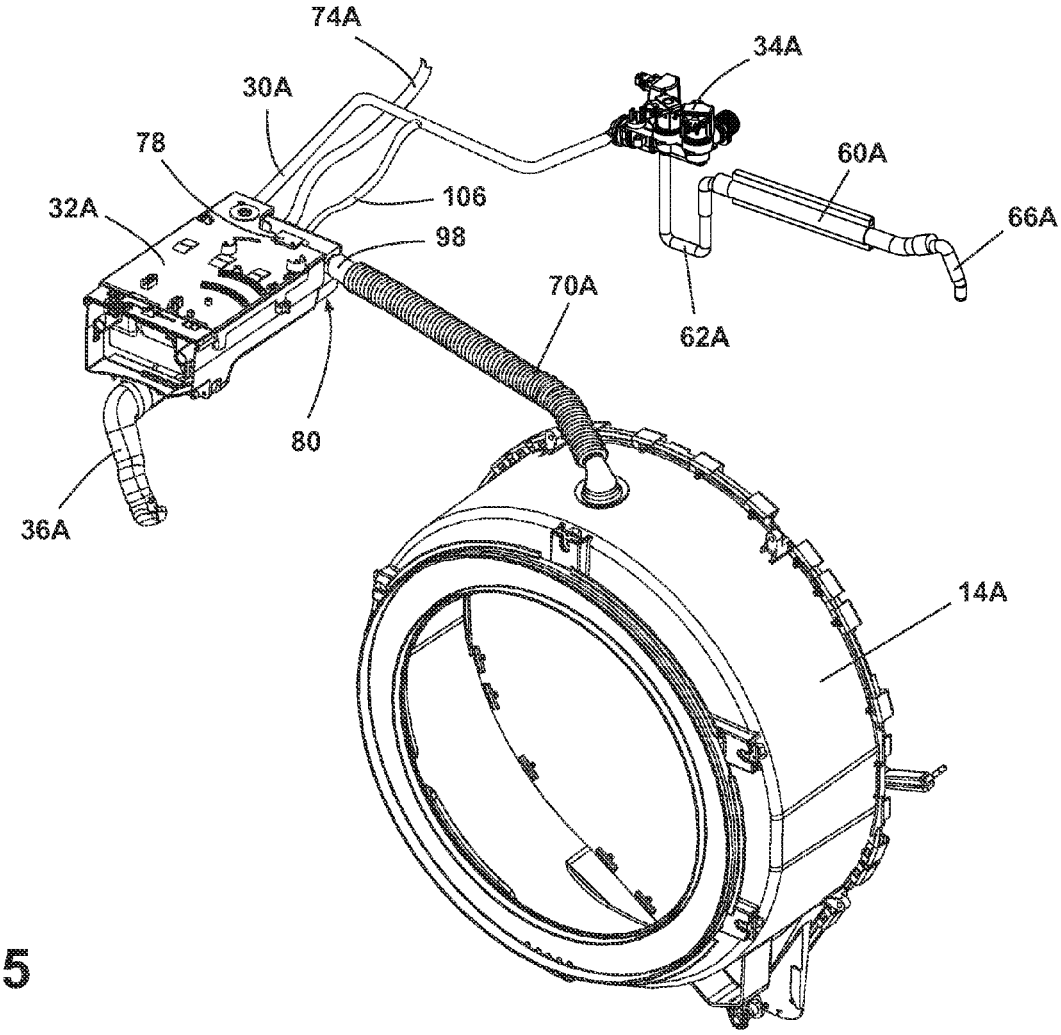
FIG. 5 is a perspective view of select components of an exhaust system, a steam generator system, and a liquid supply and recirculation system of the washing machine of FIG. 4.
Figure 6:
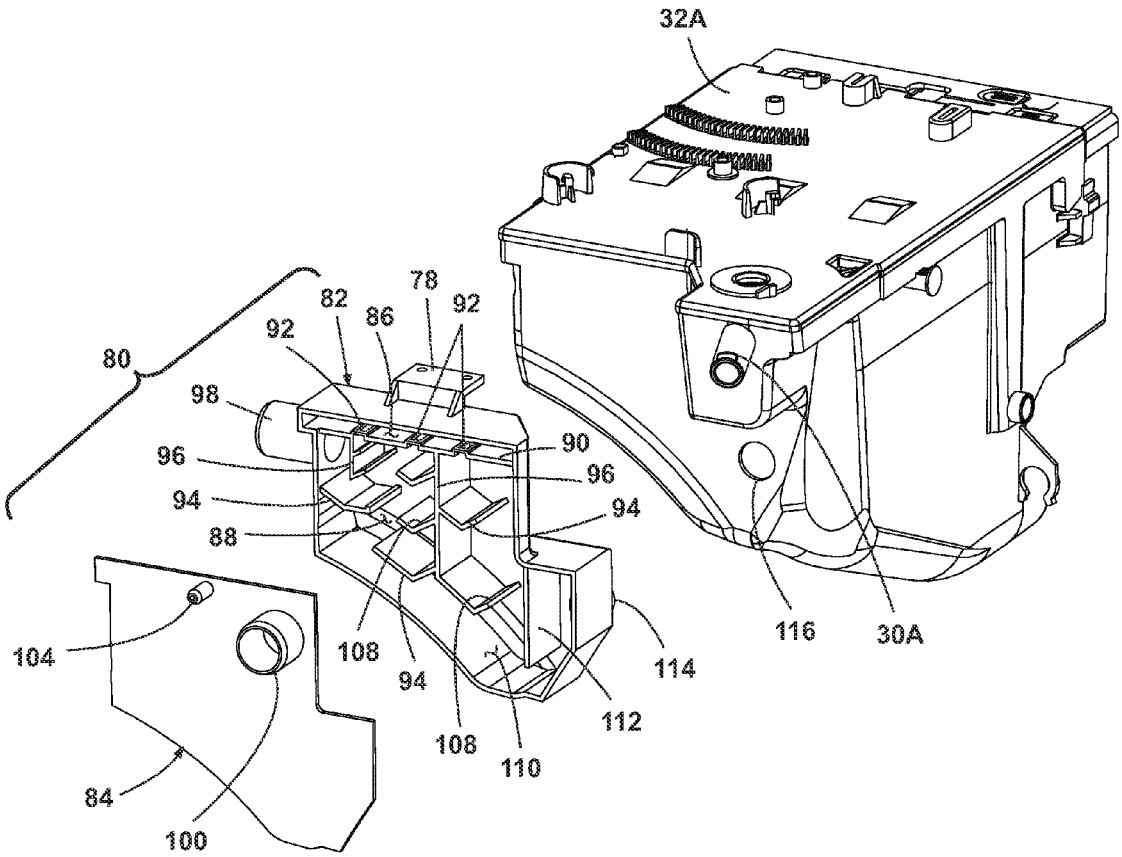
FIG. 6 is a perspective view of a detergent dispenser and condenser from the washing machine of FIG. 4.

An alternative exhaust system is illustrated in FIGS. 4-6 with respect to an alternative exemplary washing machine 10A. The components of the washing machine 10A similar to those of the first embodiment washing machine 10 are identified with the same reference numeral bearing the letter "A." Referring particularly to FIG. 4, which is a perspective view of the washing machine 10A with a top panel of the cabinet 12A removed, the exhaust system comprises an exhaust conduit 70A fluidly coupled to the tub 14A. As with the previous embodiment of the exhaust system, the exhaust conduit 70A can be coupled to a top portion of the tub 14A, as shown in FIG. 4, or any other suitable portion of the tub 14A. Because steam naturally rises, locating the exhaust conduit 70A at the top of the tub 14A takes advantage of the inherent flow behavior of the steam.

Referring now to FIG. 5, which is a perspective view of certain components of the exhaust system, the steam generator system, and the liquid supply and recirculation system, the exhaust conduit 70A directs the steam to a condenser 80. As shown in the illustrated embodiment, the condenser 80 can be coupled to the detergent dispenser 32A. The condenser 80 comprises a mounting bracket 78 that facilitates mounting the condenser 80 to the detergent dispenser 32A. Alternatively, the condenser 80 can be integrally formed with the detergent dispenser 32A.

Referring now to FIG. 6, which is an exploded view of the condenser 80 and the detergent dispenser 32A, the condenser 80 comprises an open-front housing 82 closed by a cover 84. The housing 82 defines an upper, shower chamber 86 and a lower, condensing chamber 88 separated by a divider 90 having openings 92 that fluidly couple the shower chamber 86 to the condensing chamber 88. The condensing chamber 88 includes a plurality of ribs 94 and vertical walls 96 that define a labyrinth pathway through the condensing chamber 88 from a condenser steam inlet 98 to a condenser steam outlet 100, which is formed in the cover 84 in the illustrated embodiment. The exhaust conduit 70A couples to the condenser 80 at the condenser steam inlet 98. A second exhaust conduit 74A fluidly couples the condenser steam outlet 100 to the atmosphere external to the washing machine 10A (FIGS. 4 and 5).

The condenser 80 further includes a condenser water inlet 104, which is formed in the cover 84 in the illustrated embodiment, coupled to the water supply 28A via a condenser water conduit 106 (FIGS. 4 and 5). The condenser water conduit 106 can branch from the first supply conduit 30A to the detergent dispenser 32A or can be separately coupled to the inlet valve 34A. Alternatively, the condenser water conduit 106 can be coupled to the second supply conduit 62A that provides water from the water supply 28A to the steam generator 60A. When the condenser water conduit 106 branches from the first supply conduit 30A or the second supply conduit 62A, a valve can be positioned in the condenser water conduit 106 to control the flow of water to the condenser 80.

The water from the water supply 28A can enter the shower chamber 86 through the condenser water inlet 104 and flow into the condensing chamber 88 via the openings 92 in the divider 90. The ribs 94 in the condensing chamber 88 can be configured, such as by being generally V-shaped, to form a well 108 that can hold water flowing from the shower chamber 86. The condenser 80 further includes a reservoir 110 formed at the bottom of the condensing chamber 88. Above the reservoir 110, a steam barrier 112 in the form of a generally vertical wall separates the condensing chamber 88 from a condenser water outlet 114. When the reservoir 110 holds a sufficient amount of water such that the water reaches at least a lowest point of the steam barrier 112, the steam barrier 112 and the water in the reservoir 110 prevent steam from leaking from the labyrinth path in the condensing chamber 88 to the condenser water outlet 114. The condenser water outlet 114 fluidly couples the condenser 80 with the detergent dispenser 32A via an aperture 116 in the detergent dispenser 32A.

In operation, exhaust steam from the fabric treatment chamber flows through the exhaust conduit 70A to the condenser steam inlet 98, where the steam enters the labyrinth path in the condensing chamber 88. As the steam flows through the labyrinth path, the steam contacts the ribs 94, and heat transfer between the steam and the ribs 94 facilitates condensing the steam. Additionally, cold water flowing from the shower chamber 86 into the wells 108 of the ribs 94 cools the ribs 94 to further facilitate heat transfer between the ribs 94 and the steam. The steam condenses to water, which collects in the reservoir 110. Thus, the reservoir 110 can hold water from condensed steam, water overflowing from the wells 108, and water provided directly from the shower chamber 86. As the water level in the reservoir 110 increases, such as due to steam condensation, the water reaches the condenser water outlet 114 and leaves the condenser 80 through the condenser water outlet 114. The water flows into the detergent dispenser 32A through the aperture 116. The water supplied to the detergent dispenser 32A from the condenser 80 can remain in the detergent dispenser 32A for future use. Optionally, the water in the detergent dispenser 32A can be drained in the manner described above for the first embodiment exhaust system.

If the condenser 80 does not condense all of the steam provided through the condenser steam inlet 98, then the excess steam can leave the condenser 80 and flow to the atmosphere external to the washing machine 10A. At the end of the labyrinth path, the steam flows through the condenser steam outlet 100 and the second exhaust conduit 74A to the atmosphere external to the washing machine 10A. Thus, in the exemplary exhaust system just described, the steam from the fabric treatment chamber can flow through a steam exhaust passage formed by the exhaust conduit 70A to the condenser 80, and the steam exhaust passage continues through the second exhaust conduit 74A to the atmosphere.

Optionally, the second exhaust conduit 74A can ascend from the condenser steam outlet 100 to the atmosphere to take advantage of the natural upward flow behavior of steam. In such a configuration, the second exhaust conduit 74A need not ascend at all locations between the condenser steam outlet 100 and the atmosphere. To exploit the natural upward flow of the steam, the connection between the second exhaust conduit 74A and the condenser steam outlet 100 should be positioned below the connection between the second exhaust conduit 74A and the atmosphere.

Figure 7:
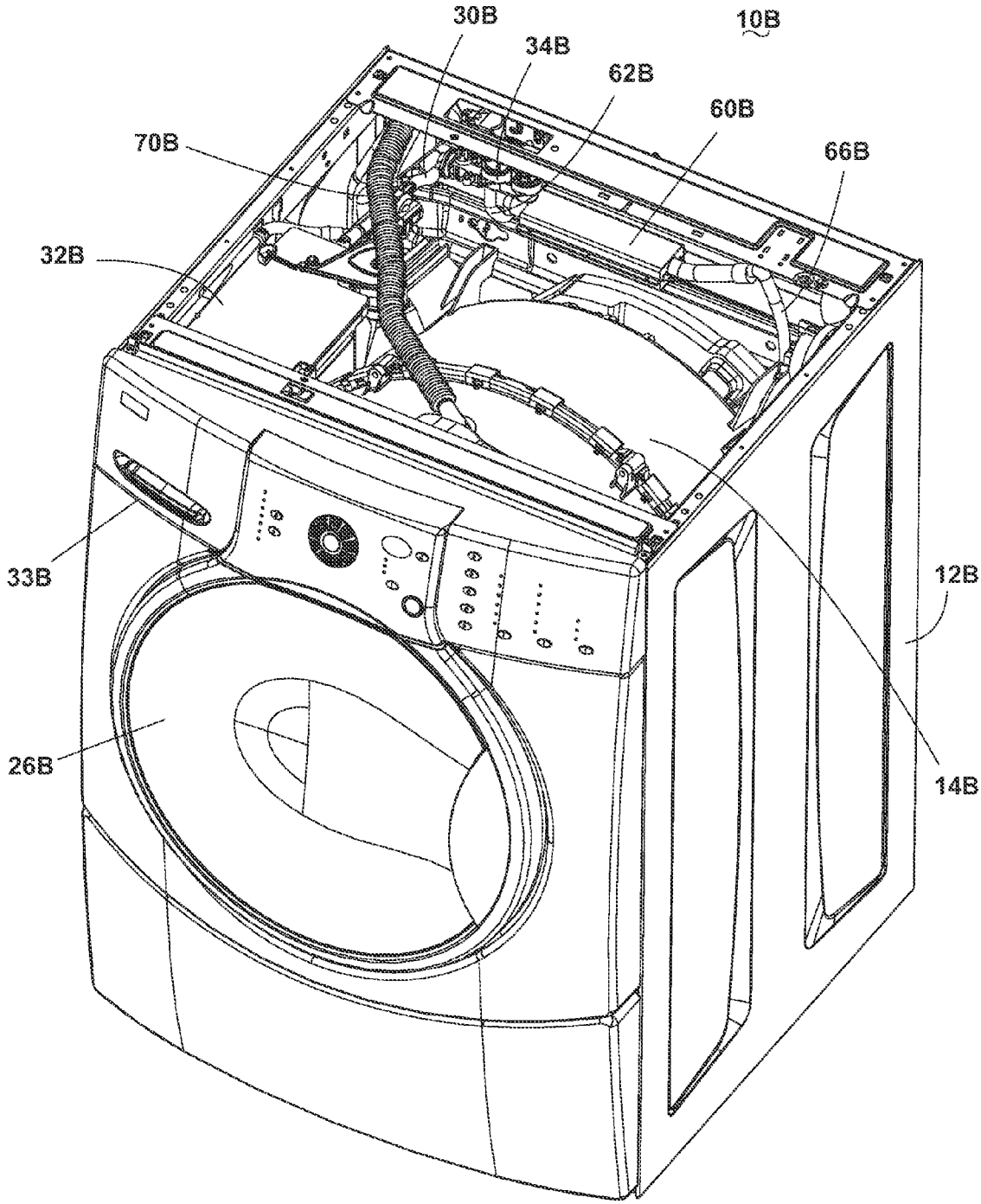
FIG. 7 is a perspective view of another alternative washing machine according to another embodiment of the invention with a top panel of a cabinet removed

As an alternative to the exhaust systems shown in FIGS. 1-6, the washing machine 10 can exhaust the steam from the fabric treatment chamber through an exhaust conduit that exhausts the steam directly to the atmosphere, as illustrated in FIG. 7. FIG. 7 shows another embodiment washing machine 10B. The components of the washing machine 10B similar to those of the first and second embodiment washing machines 10, 10A are identified with the same reference numeral bearing the letter "B." The washing machine 10B is essentially identical to the first embodiment washing machine 10, except that the exhaust conduit 70B is coupled directly to the atmosphere rather than being coupled to the detergent dispenser 32B.

Referring back to FIG. 1, the washing machine 10 can include a temperature sensor 120 configured to determine a temperature representative of the exhaust from the fabric treatment chamber. The temperature sensor 120 can be a device that senses a temperature of the exhaust from the fabric treatment chamber. For example, the temperature sensor 120 can be a thermistor or any other well-known type of temperature sensor.

Due to a chimney effect whereby the steam exhaust rises and leaves the tub 14 through the exhaust conduit 70 due to the relatively low density of the steam exhaust, the temperature sensor 120 can be positioned in the exhaust conduit 70, as shown in FIG. 1, to determine the temperature of the exhaust in the exhaust conduit 70. However, the temperature sensor 120 can be positioned in any suitable location to determine a temperature representative of the exhaust from the fabric treatment chamber. For example, the temperature sensor 120 can be positioned entirely within the exhaust conduit 70, partially within the exhaust conduit 70, externally of the exhaust conduit 70, or spaced from the exhaust conduit 70. When the temperature sensor 120 is positioned in the exhaust conduit 70, the temperature sensor 120 can be located any suitable distance from the connection between the exhaust conduit 70 and the tub 14. For example, the temperature sensor 120 can be positioned at or near the connection between the exhaust conduit 70 and the tub 14. As the position of the temperature sensor 120 nears the fabric treatment chamber, the difference between the temperature of the fabric items and the temperature determined by the temperature sensor 120 decreases.

Figure 8:
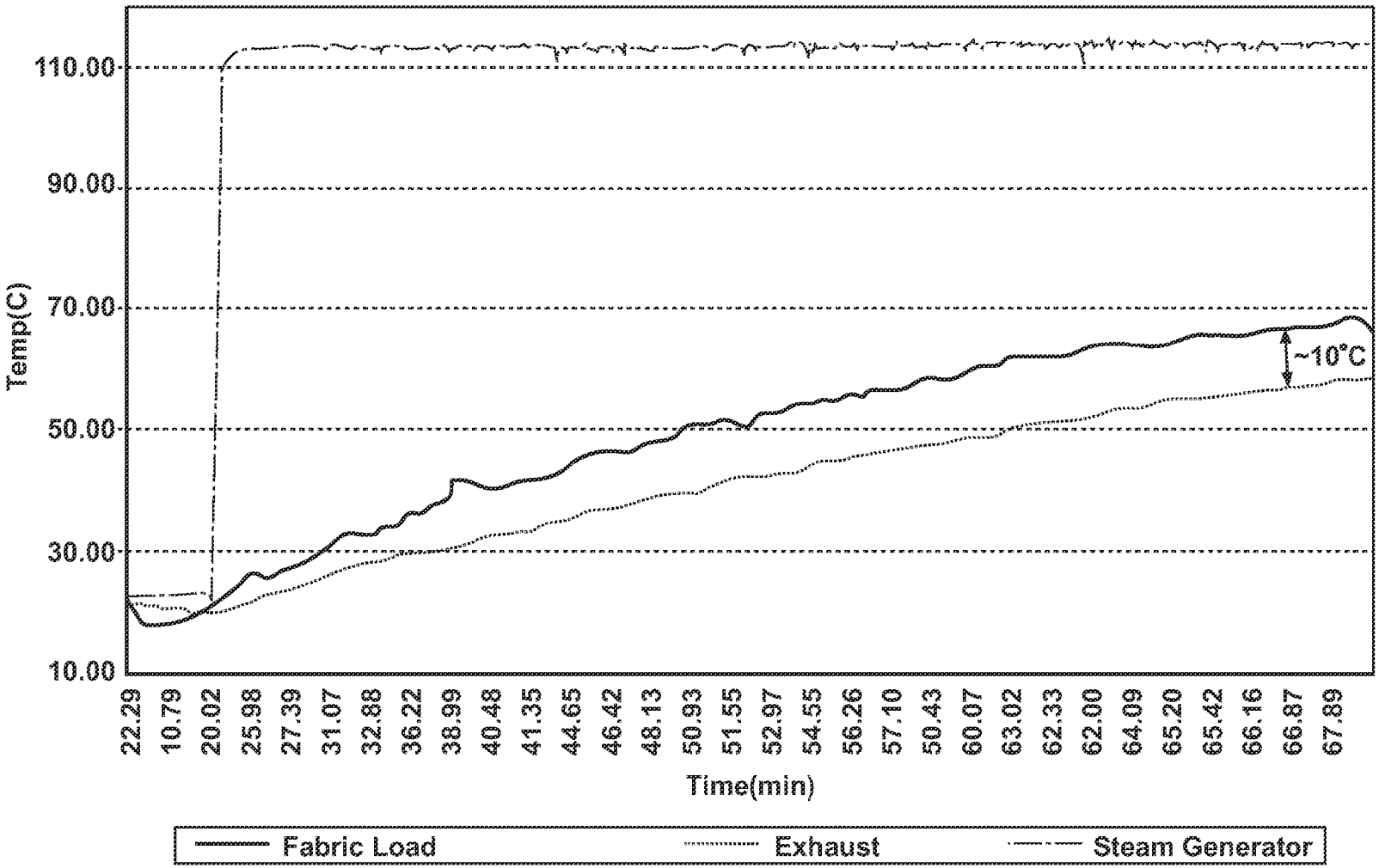
FIG. 8 is a graph depicting an exemplary differential between temperature of a fabric load and temperature determined by a temperature sensor from the washing machine of FIG. 1.

The temperature sensor 120 can be coupled to the controller of the washing machine 10 to communicate the determined temperature representative of the exhaust to the controller. The controller can utilize the determined temperature to determine a temperature of fabric items in the fabric treatment chamber. The controller can store a relationship between the temperature of the fabric items and the determined temperature and utilize the relationship to determine the temperature of the fabric items. The relationship between the temperature of the fabric items and the determined temperature can be an empirically determined relationship. For example, the temperature of the fabric items and the determined temperature can differ by an empirically determined quantity. FIG. 8 presents a graph showing an exemplary relationship between the temperature of the fabric items and the determined temperature for a 7 kg fabric load and a laundry weight to water weight ratio of 1:2. After the fabric items reach a temperature of about 40° C., the difference between the temperature of the fabric items and the determined temperature is about 10° C. Thus, when the temperature sensor 120 detects a temperature of about 30° C. or above, the temperature of the fabric items in the illustrated example can be estimated by adding about 10° C., which can be considered a correction factor, to the determined temperature.

The controller can utilize the determined temperature to control the operation of the washing machine 10 or individual components of the washing machine 10. The controller can be configured to convert the determined temperature to the temperature of the fabric items and control the operation of the washing machine 10 based on the temperature of the fabric items. Alternatively, the controller can be configured to control the operation of the washing machine 10 without converting the determined temperature to the temperature of the fabric items. The controller can control the washing machine 10 in any suitable manner. For example, the controller can control the operation of the steam generator 60 based on the determined temperature. The operation of the steam generator 60 can include, by example, initiating steam generation, stopping steam generation, controlling water flow into the steam generator 60, and controlling a steam generation rate, such as by controlling a heater of the steam generator 60.

The temperature sensor 120 can be employed on any type of fabric treatment appliance and washing machines other than the washing machine 10 of FIG. 1. For example, the temperature sensor 120 can be utilized in conjunction with the washing machines 10A, 10B of FIGS. 4 and 7. When the temperature sensor 120 is located in the exhaust conduit 70, the exhaust conduit 70 can have any suitable configuration, such as being coupled to a condenser or directly to the atmosphere exterior of the washing machine 10. Further, the temperature sensor 120 can be employed with any type of steam generator 60, including, but not limited to, in-line steam generators and tank-type steam generators.

As stated above, the difference between the temperature of the fabric items and the determined temperature decreases as the position of the temperature sensor 120 nears the fabric treatment chamber. Moving the temperature sensor 120 closer to the fabric treatment chamber, therefore, results in the detected temperature approaching the temperature of the fabric items. For this reason, the temperature sensor 120 can be positioned in the tub 14; however, the temperature sensor 120 is easier to service and the washing machine 10 is less expensive to manufacture when the temperature sensor 120 is located in the exhaust conduit 70.

Figure 9:
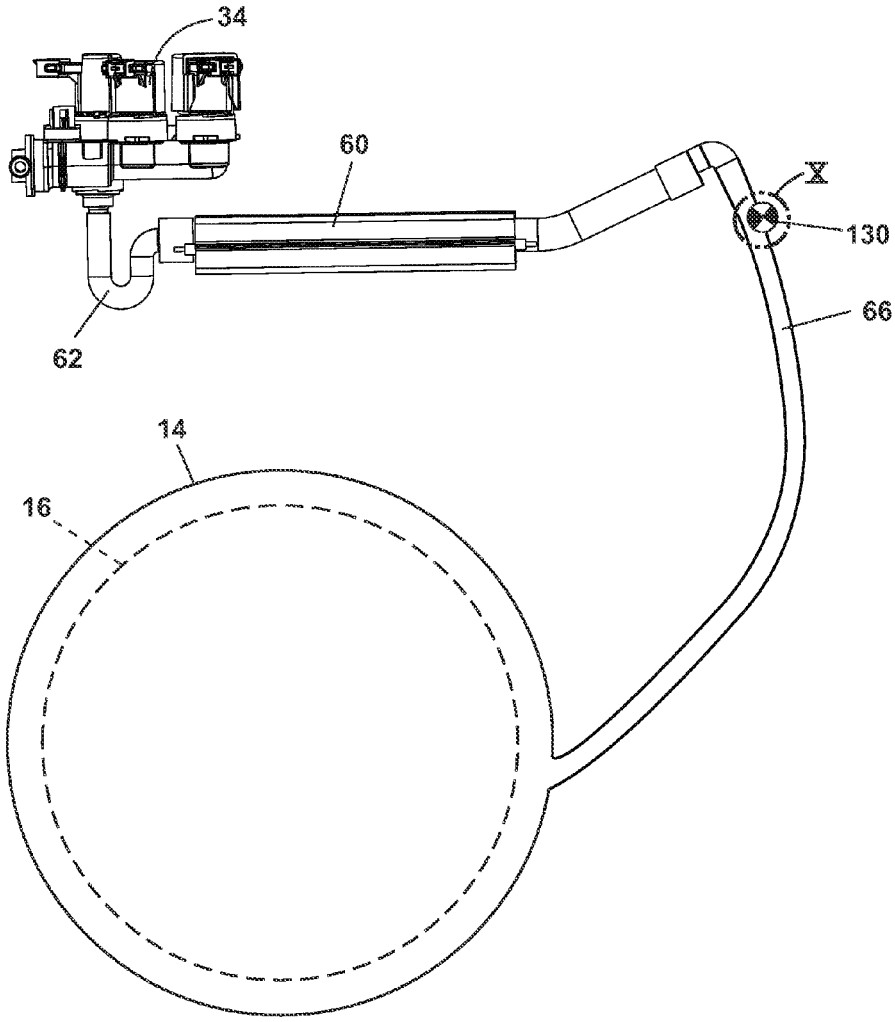
FIG. 9 is a schematic view of select components, including an anti-siphon device, of the washing machine of FIG. 1.

Referring back to FIG. 1, the washing machine 10 can further comprise an anti-siphon device 130. The anti-siphon device 130 is more clearly shown in FIG. 9, which is a schematic view of the inlet valve 34, the second supply conduit 62, the steam generator 60, the steam conduit 66, the tub 14, the drum 16, and the anti-siphon device 130. In a fabric treatment appliance without the anti-siphon device 130, pressure within the steam conduit 66 can draw (i.e., siphon) liquid from the tub 14 and/or the drum 16 into the steam conduit 66 and to the steam generator 60. Backflow of the liquid to the steam generator 60 is undesirable; the liquid can contain detergents or other wash aids that can potentially detrimentally affect the performance of the steam generator 60, and if the siphon draws a sufficient amount of liquid from the tub 14 and/or the drum 16, the liquid can overflow the steam generator 60 and reach the inlet valve 34. To combat this effect, the anti-siphon device 130 prevents the backflow of liquid from the tub 14 and/or the drum 16 to the steam generator 60.

In the illustrated embodiment, the anti-siphon device 130 is located in the steam conduit 66 downstream from the steam generator 60. It is within the scope of the invention, however, to locate the anti-siphon device 130 anywhere between the inlet valve 34 and the tub 14 and/or the drum 16.

The anti-siphon device 130 controls flow of air from atmosphere external to the steam conduit 66 into the steam conduit 66 by selectively opening the steam conduit 66 to the atmosphere. The atmosphere external to the steam conduit 66 can be atmosphere within the washing machine 10 or external to the washing machine 10. The anti-siphon device 130 can be any suitable type of device that can control the flow of air. For example, the anti-siphon device 130 can be a valve, such as a check valve that allows air to flow from the atmosphere into the steam conduit 66 but does not allow steam to pass from the steam conduit 66 to the atmosphere. Examples of the anti-siphon device 130 in the form of a check valve are illustrated in FIGS. 10-13.

Figure 10:
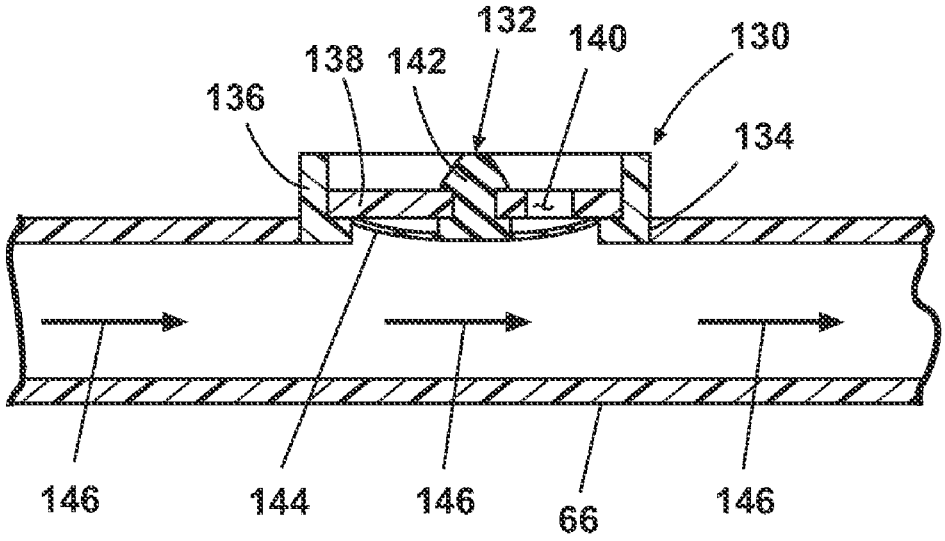
FIG. 10 is a sectional view of the region labeled X in FIG. 9, wherein the anti-siphon device in the form of an umbrella valve is in a closed position.

FIG. 10 presents a sectional view of the steam conduit 66 and the anti-siphon device 130 in the form of an umbrella valve 132. The umbrella valve 132 resides within an opening 134 in the steam conduit 66. The opening 134 fluidly couples the atmosphere to the interior of the steam conduit 66, and the umbrella valve 132 selectively closes the opening 134. The umbrella valve 132 comprises a housing 136 and a valve support 138 mounted to the housing 136. The valve support 138 forms an aperture 140 and supports a valve member 142 having a resilient diaphragm 144. The aperture 140 fluidly couples the atmosphere to the steam conduit 66, and the diaphragm 144 has a normally closed position, as shown in FIG. 10, where the diaphragm 144 closes the aperture 140 and thereby prevents fluid communication between the atmosphere and the steam conduit 66. When the diaphragm 144 is in the closed position, steam from the steam generator 60 can flow through the steam conduit 66 to the tub 14 and/or the drum 16, as indicated by solid arrows 146 in FIG. 10.

Figure 11:
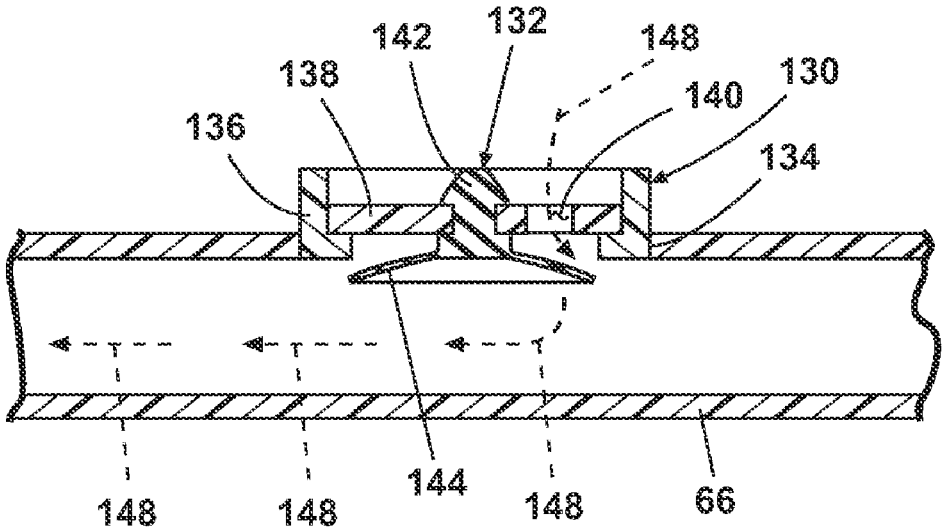
FIG. 11 is a sectional view similar to FIG. 10, wherein the umbrella valve is in an opened position.

When a pressure within the steam conduit 66 falls below a predetermined pressure, the diaphragm 144 moves to an opened position, as shown in FIG. 11, where the diaphragm 144 no longer closes the aperture 140. When the diaphragm 144 is in the opened position, air from the atmosphere can flow through the aperture 140 and into the steam conduit 66, as indicated by dashed arrows 148 in FIG. 11. Thus, rather than the pressure in the steam conduit 66 drawing liquid from the tub 14 and/or the drum 16, the pressure draws the air from the atmosphere. The predetermined pressure can be any suitable pressure, such as a pressure below atmospheric pressure. An example of suitable pressures below atmospheric pressure are pressures less than or equal to about 0.5 bar.

Figure 12:
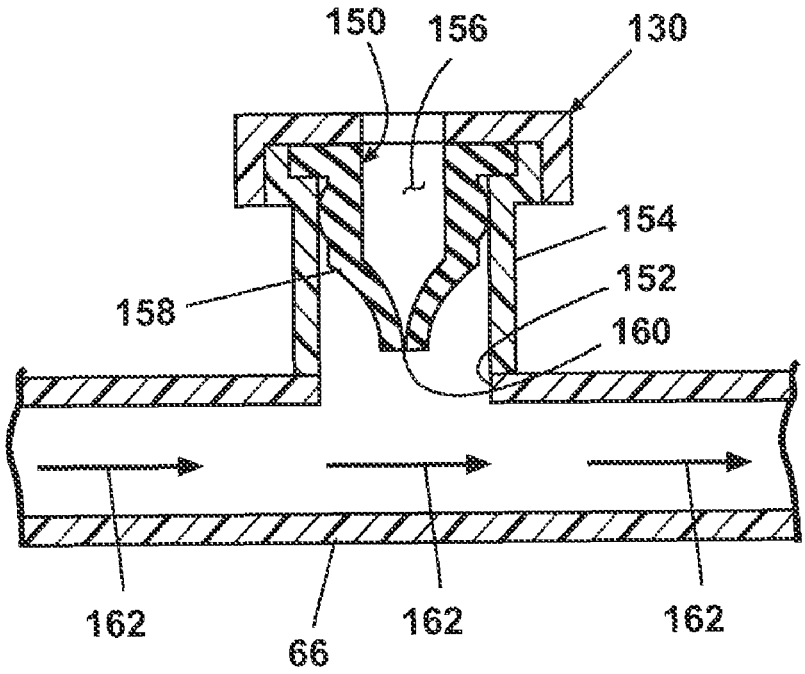
FIG. 12 is sectional view similar to FIG. 10, wherein the anti-siphon device is in the form of a duckbill valve in a closed position.

FIG. 12 presents a sectional view of the steam conduit 66 and the anti-siphon device 130 in the form of a duckbill valve 150. The duckbill valve 150 resides within an opening 152 in the steam conduit 66. The opening 152 fluidly couples the atmosphere to the interior of the steam conduit 66, and the duckbill valve 150 selectively closes the opening 152. The duckbill valve 150 comprises a housing 154 that forms an aperture 156 and supports a valve member 158 located in the aperture 156 and having an air passageway 160. The aperture 156 fluidly couples the atmosphere to the steam conduit 66, and the valve member 158 has a normally closed position, as shown in FIG. 12, where the valve member 158 contracts to close the air passageway 160 and thereby closes the aperture 156. Thus, when the valve member 158 is in the closed position, the valve member 158 prevents fluid communication between the atmosphere and the steam conduit 66, and steam from the steam generator 60 can flow through the steam conduit 66 to the tub 14 and/or the drum 16, as indicated by solid arrows 162 in FIG. 12.

Figure 13:
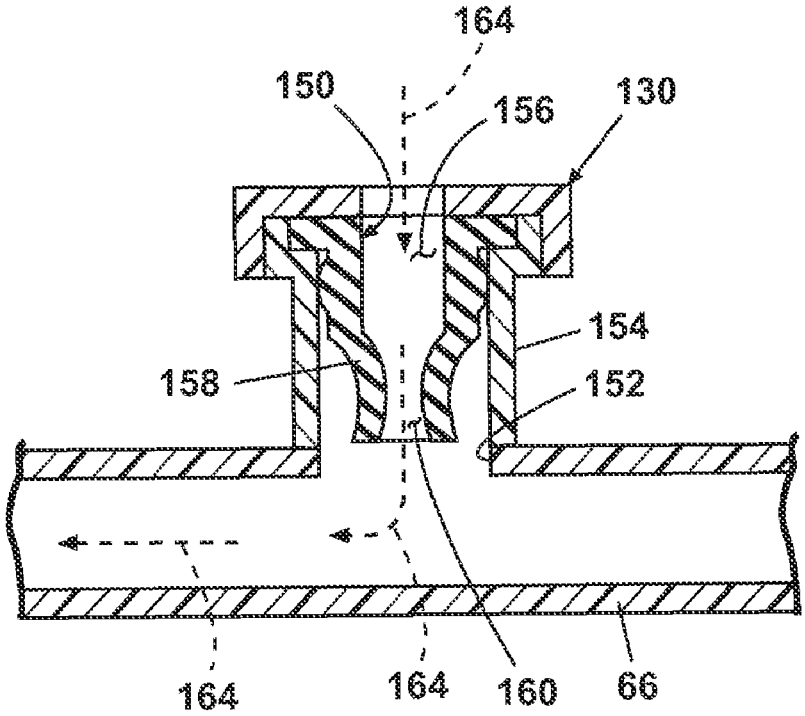
FIG. 13 is a sectional view similar to FIG. 12, wherein the duckbill valve is in an opened position.

When a pressure within the steam conduit 66 falls below a predetermined pressure, the valve member 158 moves to an opened position, as shown in FIG. 13, where the valve member 158 expands to open the air passageway 160 and no longer close the aperture 156. When the valve member 158 is in the opened position, air from the atmosphere can flow through the aperture 156 and into the steam conduit 66, as indicated by dashed arrows 164 in FIG. 13. Thus, rather than the pressure in the steam conduit 66 drawing liquid from the tub 14 and/or the drum 16, the pressure draws the air from the atmosphere. As with the duckbill valve 150, the predetermined pressure can be any suitable pressure, such as a pressure below atmospheric pressure. An example of suitable pressures below atmospheric pressure are pressures less than or equal to about 0.5 bar.

The anti-siphon device 130 can be employed on any type of fabric treatment appliance and washing machines other than the washing machine 10 of FIG. 1. For example, the anti-siphon device 130 can be utilized in conjunction with the washing machines 10A, 10B of FIGS. 4 and 7. Further, the anti-siphon device 130 can be employed with any type of steam generator 60, including, but not limited to, in-line steam generators and tank-type steam generators.

Figure 14:
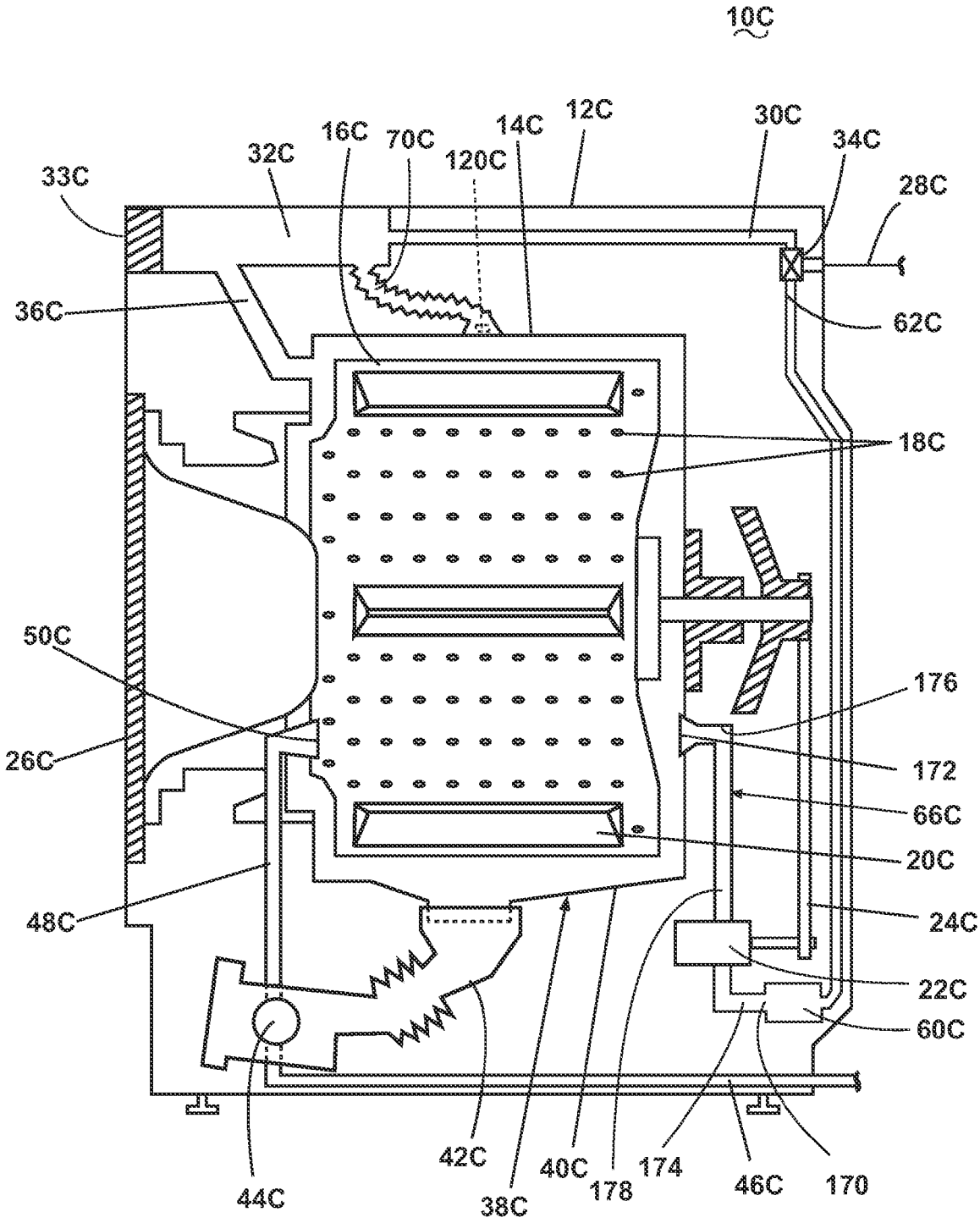
FIG. 14 is a schematic view another alternative washing machine according to another embodiment of the invention, wherein a steam generator is positioned below a tub of the washing machine, and a generally ascending conduit couples the steam generator to the tub.

An alternative embodiment washing machine 10 is illustrated schematically in FIG. 14, where components similar to those of the first embodiment washing machine 10 of FIG. 1 are identified with the same numeral bearing the letter "C." The alternative embodiment washing machine 10C is substantially identical to the washing machine 10 of FIG. 1, except for the location of the steam generator 60C and the steam conduit 66C. In the washing machine 10C, the steam generator 60C is positioned below the tub 14C, and the steam conduit 66C, which has an inlet 170 fluidly coupled to the steam generator 60C and an outlet 172 fluidly coupled to the tub 14C, generally ascends from the steam generator 60C to the tub 14C. By having a generally ascending configuration, the steam conduit 66C takes advantage of the natural tendency of the steam to rise for delivery of the steam to the tub 14C and/or the drum 16C. Using the generally ascending configuration is especially useful when the steam is not pressurized; the generally ascending configuration can guide the rising steam from the steam generator 60C to the tub 14C and/or the drum 16C. When the steam is pressurized, the pressure forces the steam through the steam conduit, regardless of the configuration of the steam conduit.

Figure 15A:
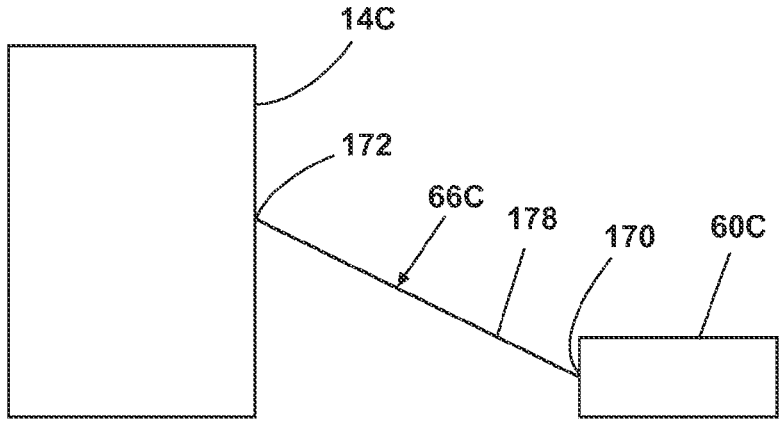
FIGS. 15A-15C are schematic views of the steam generator, the tub, and exemplary configurations of the generally ascending conduit.
Figure 15B:
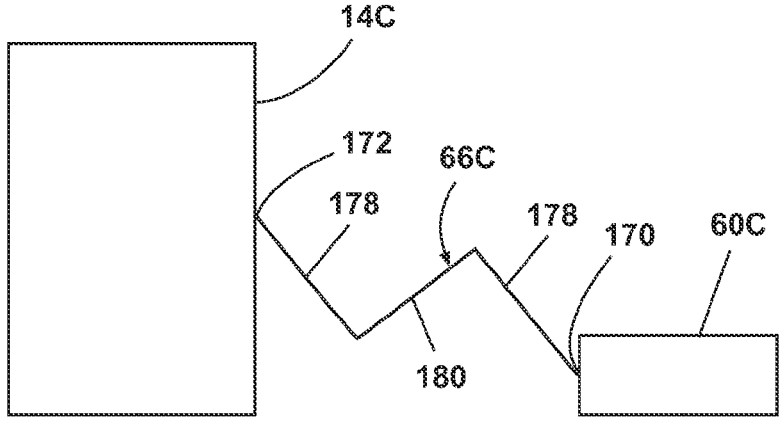
Figure 15C:
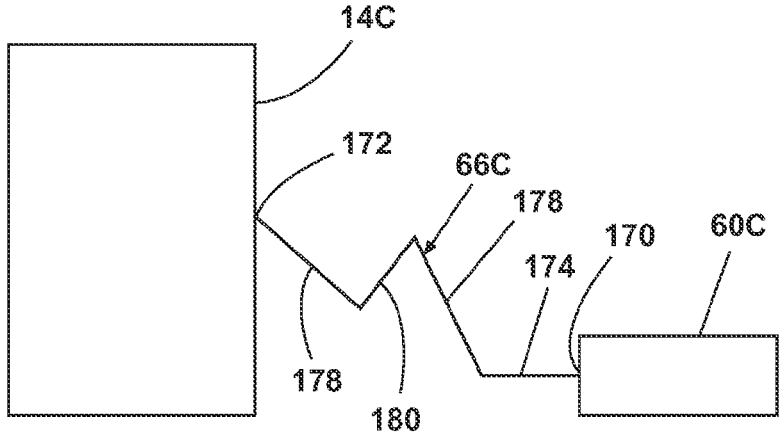

According to one embodiment, the steam conduit 66C is configured such that the outlet 172 defines a high point (i.e., the most vertical point) of the steam conduit 66C. In such a configuration, the steam will continue to flow within the steam conduit 66C and rise until it reaches the outlet 172 for delivery into the tub 14 and/or the drum 16. The steam conduit 66C, therefore, does not have to be entirely ascending; it can comprise ascending portions, descending portions, horizontal portions, and combinations thereof. The steam conduit 66C in FIG. 14 comprises a first generally horizontal portion 174 near the inlet 170, a second generally horizontal portion 176 near the outlet 172, and an ascending portion 178 between the first and second horizontal portions 174, 176. Other exemplary configurations of the generally ascending steam conduit 66C are shown schematically in FIGS. 15A-15C. In FIG. 15A, the steam conduit 66C comprises only an ascending portion 178. The steam conduit 66C of FIG. 15B comprises a descending portion 180 between a pair of ascending portions 178. In FIG. 15C, the steam conduit 66C comprises a descending portion 180 between two ascending portions 178 and a horizontal portion 174 between one of the ascending portions 178 and the steam generator 60C.

For the steam conduit 66C to be generally ascending when the steam conduit 66C is coupled to the tub 14C and/or the drum 16C, the steam generator 60C must be located below a high point of the tub 14C and/or the drum 16C. As stated above, the steam generator 60C in FIG. 14 is located below the tub 14C. The steam generator 60C can also be located adjacent to the tub 14C and/or the drum 16C, as illustrated in FIG. 16.

Figure 16:
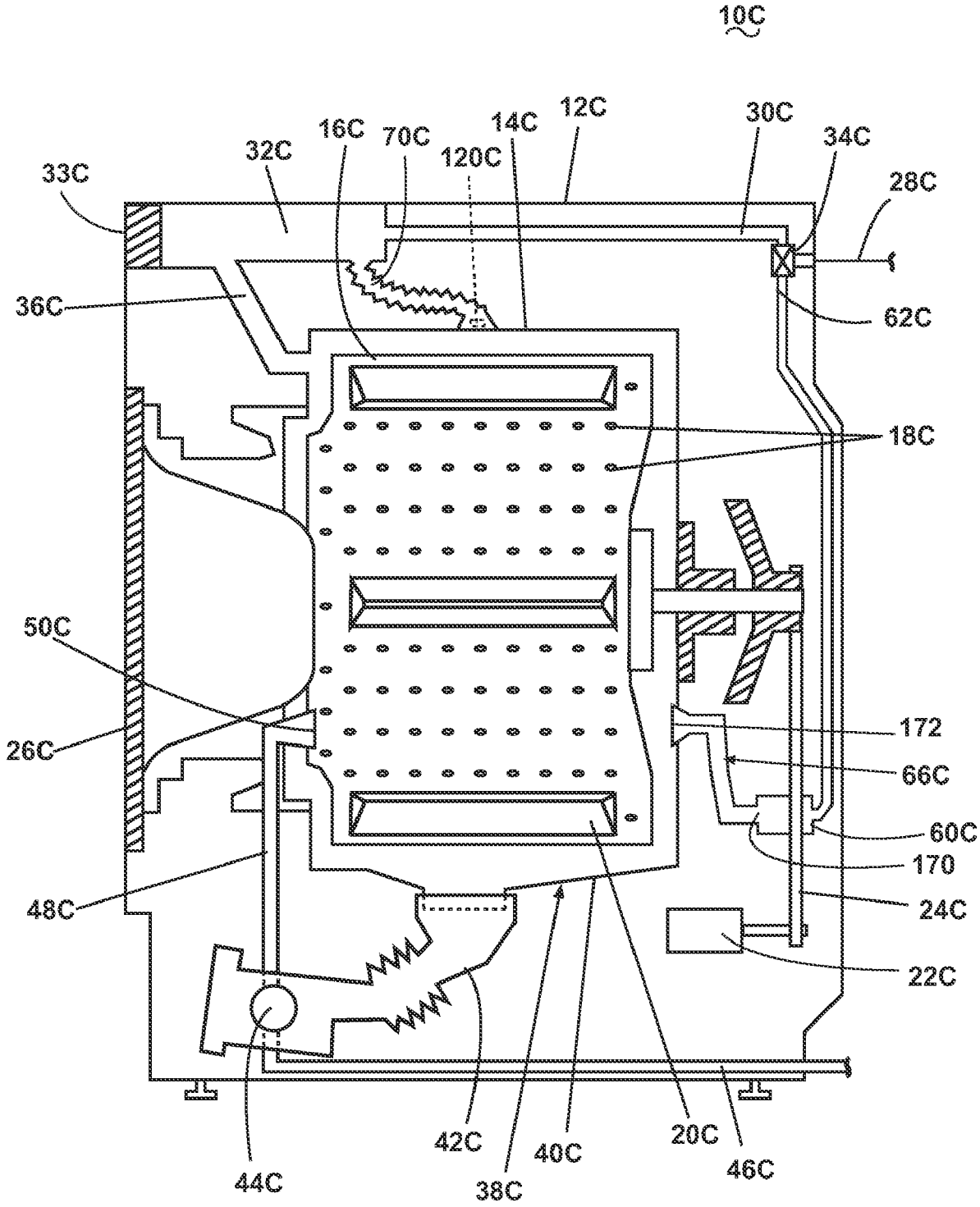
FIG. 16 is a schematic view of the washing machine of FIG. 14, wherein the steam generator is positioned adjacent to the tub, and the generally ascending conduit couples the steam generator to the tub.

The generally ascending steam conduit 66C can be employed on any type of fabric treatment appliance and washing machines other than the washing machine 10C of FIGS. 14 and 16. Further, the generally ascending steam conduit 66C can be employed with any type of steam generator 60C, including, but not limited to, in-line steam generators and tank-type steam generators.

The various features of the washing machines 10, 10A, 10B, 10C can be used in conjunction with one another or independently of one another. For example, the steam exhaust conduit 70 (either coupled to a condenser or coupled directly to the atmosphere), the temperature sensor 120, the anti-siphon device 130, and the generally ascending steam conduit 66C can be employed in any combination or alone in a fabric treatment appliance While the invention has been specifically described in connection with certain specific embodiments thereof, it is to be understood that this is by way of illustration and not of limitation, and the scope of the appended claims should be construed as broadly as the prior art will permit.

What is claimed is:

1. A fabric treatment appliance comprising:

a drum rotatably mounted within a tub with at least one of the tub and drum defining a fabric treatment chamber;

a non-pressurized steam delivery system comprising:

a steam generator having a steam generation chamber with a steam generator inlet fluidly coupled to a water supply to receive water in the steam generation chamber and a steam generator outlet in unrestricted fluid communication with the fabric treatment chamber to supply non-pressurized steam relative to the fabric treatment chamber; and a steam conduit in unrestricted fluid communication with the fabric treatment chamber and having a steam conduit inlet fluidly coupled to the steam generator outlet and a steam conduit outlet fluidly coupled to the fabric treatment chamber;

wherein the steam conduit outlet of the steam conduit defines a high point higher than any other point of the steam conduit and wherein non-pressurized steam rising from the steam generator is guided into the fabric treatment chamber through the steam conduit.

2. The fabric treatment appliance of claim 1 wherein the steam conduit comprises at least one ascending portion and at least one horizontal portion between the steam conduit inlet and the steam conduit outlet.

3. The fabric treatment appliance of claim 1 wherein the steam conduit is connected to the tub.

4. The fabric treatment appliance of claim 1 wherein the steam generator is located below a top of the at least one of the tub and drum.

5. The fabric treatment appliance of claim 4 wherein the steam generator is located adjacent to the at least one of the tub and drum.

6. The fabric treatment appliance of claim 4 wherein the steam generator is located below the at least one of the tub and drum.

7. The fabric treatment appliance of claim 1, wherein the steam generator is an in-line steam generator.

8. The fabric treatment appliance of claim 1, wherein the steam generator is a tank-type steam generator.

9. The fabric treatment appliance of claim 1 wherein the steam conduit comprises only ascending portions between the steam conduit inlet and the steam conduit outlet.

10. The fabric treatment appliance of claim 1 wherein the steam conduit comprises at least one ascending portion and at least one descending portion between the steam conduit inlet and the steam conduit outlet.

11. The fabric treatment appliance of claim 10 wherein the steam conduit further comprises at least one horizontal portion between the steam conduit inlet and the steam conduit outlet.

* * * * *